US005564763A

United States Patent [19]

Mercurio

[11] Patent Number: 5,564,763

[45] Date of Patent: Oct. 15, 1996

[54] DEVICE FOR PICKING UP AND REMOVING DOG DROPPINGS

[76] Inventor: Cindy P. Mercurio, 2136 Tall Oak Ct., Sarasota, Fla. 34232

[21] Appl. No.: 552,241

[22] Filed: Nov. 2, 1995

[51] Int. Cl.[6] ..... A01K 29/00; E01H 1/12

[52] U.S. Cl. ..... 294/1.3

[58] Field of Search ..... 294/1.3, 1.4, 8.5, 294/11, 16, 25, 50.8, 55; 15/104.8, 257.1, 257.4, 257.6; 119/161; D30/161, 162

[56] References Cited

U.S. PATENT DOCUMENTS

| | | | |
|---|---|---|---|
| D. 259,968 | 7/1981 | Schneider | 294/1.3 X |
| 3,685,088 | 8/1972 | Doherty . | |
| 3,813,121 | 5/1974 | Marvin . | |
| 3,854,578 | 12/1974 | Sharpe . | |
| 4,148,510 | 4/1979 | Brack et al. . | |
| 4,186,955 | 2/1980 | Campbell . | |
| 4,273,370 | 6/1981 | Kjaer . | |
| 4,341,410 | 7/1982 | Summach . | |
| 4,747,633 | 5/1988 | Stacy | 294/1.3 |
| 4,875,729 | 10/1989 | Peck . | |
| 4,900,077 | 2/1990 | Beck . | |
| 5,000,500 | 3/1991 | Almog . | |
| 5,037,149 | 8/1991 | Beck . | |
| 5,054,828 | 10/1991 | Hantover . | |
| 5,186,506 | 2/1993 | Gale . | |
| 5,318,330 | 6/1994 | Dombrowski . | |
| 5,358,295 | 10/1994 | Campbell . | |
| 5,359,840 | 11/1994 | Costar | 294/25 X |

*Primary Examiner*—Johnny D. Cherry
*Attorney, Agent, or Firm*—Charles J. Prescott

[57] ABSTRACT

A device for picking up and removing dog droppings and the like including a pair of clamshell shaped members each having a concaved inner surface which face one another and held for pivotal movement near spaced first side margins of the clamshell shaped members by a biased hinge connection therebetween. Elongated spaced arcuate fingers are formed into each clamshell shape member which extend from a second side margin to a central portion of each clamshell shaped member. Two opposing spaced handles each extend from the first side margin, when held and squeezed together, separate the second side margins defined by the spaced distal ends of the fingers. A flexible disposable bag of thin plastic is operably positionable between the opened clamshell spaced members, the bottom of the bag furthest into the space therebetween, an open end portion of the bag turned inside out and positioned against an exterior convex surface of each clamshell shaped member, including the fingers. Retaining loops formed at each corner of the open end of the bag supportively engage around holding tabs which extend in either direction from each end margin of at least one clamshell shaped member.

3 Claims, 3 Drawing Sheets

DEVICE FOR PICKING UP AND REMOVING DOG DROPPINGS

BACKGROUND OF THE INVENTION

1. Scope of Invention

This invention relates generally to devices for pick up and removal of animal excrement, and more particularly to an improved device for the proper disposal of dog droppings and the like.

2. Prior Art

Because of the unsightly and unsanitary nature of dog droppings along the sidewalks and roads, many communities have enacted regulations and laws requiring that pet owners not only leash dogs during walks, but also require the pick up and removal of any dog droppings deposited during the walk. In some cases, severe penalties are provided for enforcement of violations.

A vast array of devices have been both patented and marketed which facilitate both pick up and removal of dog droppings and the like. A simple device for accomplishing same is the utilization of a small plastic disposable bag or pouch into which the dog's owner places the hand for protective manual pick up of the droppings, after which the flexible plastic bag is reversed or turned inside out and sealed or knotted to close the bag opening. A significant psychological drawback is encountered utilizing this well-known methodology, that drawback being associated with protected indirect contact with soft, squishy droppings.

Various sizes and shapes of "pooper scoopers" have also been marketed. When used directly, the inner and outer surfaces of such devices become soiled and must be rinsed or washed after each use. The addition of a plastic bag fitted therewithin may avoid the necessity of frequent cleaning. However, these disposable plastic bags may be difficult to insert and to be maintained in position while the scooper is utilized.

A number of U.S. Patents disclose devices for this purpose similar to the present invention having opposing pivotally connected members moveable toward and away from one another for use in conjunction with a disposable plastic bag for the pick up and removal of droppings. One such device is disclosed in U.S. Pat. No. 4,273,370 invented by Kjaer which teaches gripping members hingedly connected to one another and arranged to be moved toward one another at the free ends of the gripping members. A flexible bag is positionable between the gripping members, the open end of the bag being folded about the mouth portion defined by the free edges of the gripping members. This device also includes means for holding a row of such bags in position ready for positioning and use.

Gale, in U.S. Pat. No. 5,186,506 has also invented a device for pick up and removal of animal excrement. This invention teaches a pair of elongated tong members pivotally connected about an intermediate point therebetween. Handles formed at one end of each tong member appropriately close and open the scoop-shaped members formed at the opposite ends of the tong members which, in conjunction with a flexible disposable bag, serve to scoop the animal droppings into the partially reversed bag positioned between the scoop members.

A combination tong and disposable bag is disclosed in U.S. Pat. No. 5,358,295 invented by Campbell which teaches the use of a disposable plastic bag in combination with tongs having a pair of pivotally connected arms operably useable with the bag. The tongs include compressible contact members on an interior opposing surface of the arms which engage when the arms are partly closed and are compressed thereby, permitting the arms to become fully closed. The contact members also grip the bottom portion of the disposable bag for retention during droppings pick up.

Applicant is also aware of the following U.S. patents which are generally of a nature similar to that of the present invention, yet more distant with respect thereto than the above-described prior art as follows:

| | |
|---|---|
| U.S. Pat. No. 4,900,077 | Beck |
| U.S. Pat. No. 4,186,955 | Campbell |
| U.S. Pat. No. 3,813,121 | Marvin |
| U.S. Pat. No. 3,685,088 | Doherty |
| U.S. Pat. No. 5,318,330 | Dombrowski |
| U.S. Pat. No. 4,341,410 | Summach |
| U.S. Pat. No. 3,854,578 | Sharpe |
| U.S. Pat. No. 5,037,140 | Beck |
| U.S. Pat. No. 5,000,500 | Almog |
| U.S. Pat. No. 5,054,828 | Hantover |
| U.S. Pat. No. 4,148,510 | Brack et al. |
| U.S. Pat. No. 4,875,729 | Peck |

The present invention teaches a uniquely configured device for the pick up and removal of dog droppings and the like having a pair of clamshell shaped members which are hingedly connected, the concave surfaces of each member facing one another. The hinge includes a means for biasingly maintaining the clamshell shaped members in a closed configuration, openable by squeezing two opposing handles one extending from spaced side margins of the clamshell shaped members. Fingers are formed into the other side margin of each clamshell shaped member for assisting in digging into the grass and dirt upon which the droppings are deposited. A flexible plastic bag which is insertable between the clamshell shaped members in operational position, bottom side up, is then foldable by turning the remainder of the plastic bag inside out against the outer convex surfaces of each clamshell shaped member. Loops formed at each corner of the open margin of the bag interengage holding tabs which extend in either direction from the clamshell shaped members for maintaining the bag in operational position. The biasing means associated with the hinge maintains the plastic bag and dog droppings held within the plastic bag securely between closed clamshell shaped members for disposal.

BRIEF SUMMARY OF THE INVENTION

This invention is directed to a device for picking up and removing dog droppings and the like including a pair of clamshell shaped members each having a concaved inner surface which face one another and held for pivotal movement near spaced first side margins of the clamshell shaped members by a biased hinge connection therebetween. Elongated spaced arcuate fingers are formed into each clamshell shape member which extend from a second side margin to a central portion of each clamshell shaped member. Two opposing spaced handles each extend from the first side margin which, when held and squeezed together, separate the second side margins defined by the spaced distal ends of the fingers. A flexible disposable bag of thin plastic is operably positionable between the opened clamshell spaced members, the bottom of the bag furthest into the space therebetween, an open end portion of the bag turned inside out and positioned against an exterior convex surface of each clamshell shaped member, including the fingers.

Retaining loops formed at each corner of the open end of the bag supportively engage around holding tabs which extend in either direction from each end margin of at least one clamshell shaped member.

It is therefore an object of this invention to provide a device for the easy and convenient pick up and removal of dog droppings and the like.

It is another object of this invention to provide a device for picking up and removing dog droppings and the like which, by the utilization of a disposable plastic flexible bag, avoids direct contact with the surfaces of the hingedly connected clamshell shaped members.

It is still another object of this invention to provide a device for picking up and removing dog droppings and the like which avoids any direct or indirect hand contact with the droppings.

A still further object of this invention to provide a device for picking up and removing dog droppings and the like having closely spaced finger members for more effective engagement with the dog droppings when embedded in grass and dirt.

In accordance with these and other objects which will become apparent hereinafter, the instant invention will now be described with reference to the accompanying drawings.

DETAILED DESCRIPTION OF THE INVENTION

Figure 5:
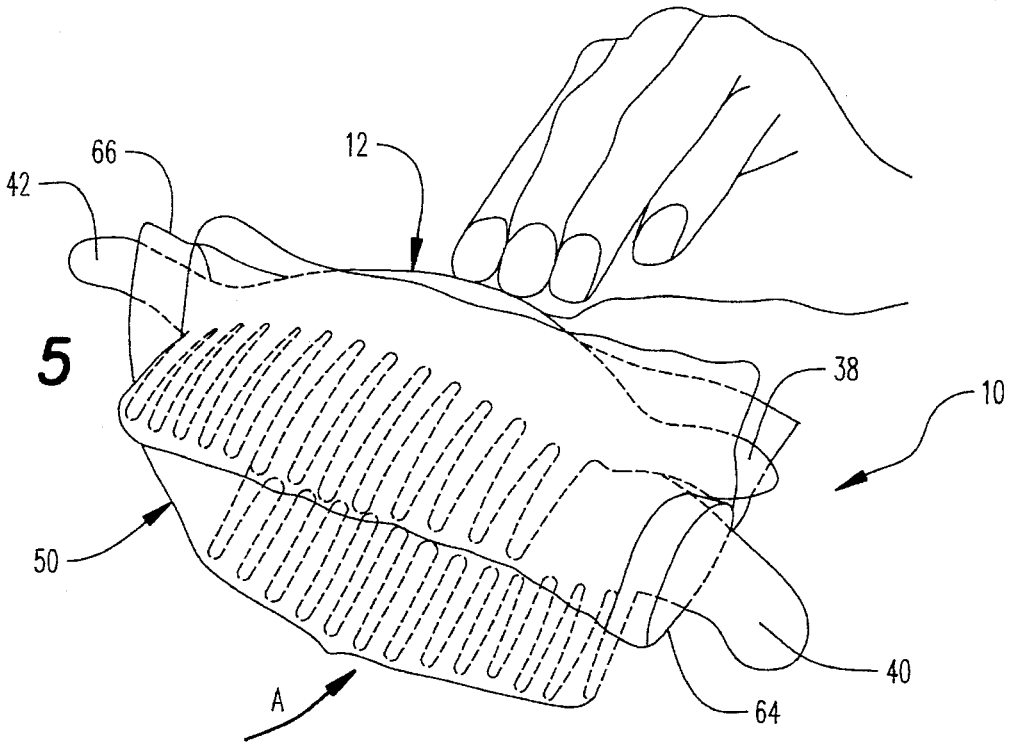
FIG. 5 is a perspective view of the invention being held in an open position with a disposable plastic bag in operational position.
Figure 6:
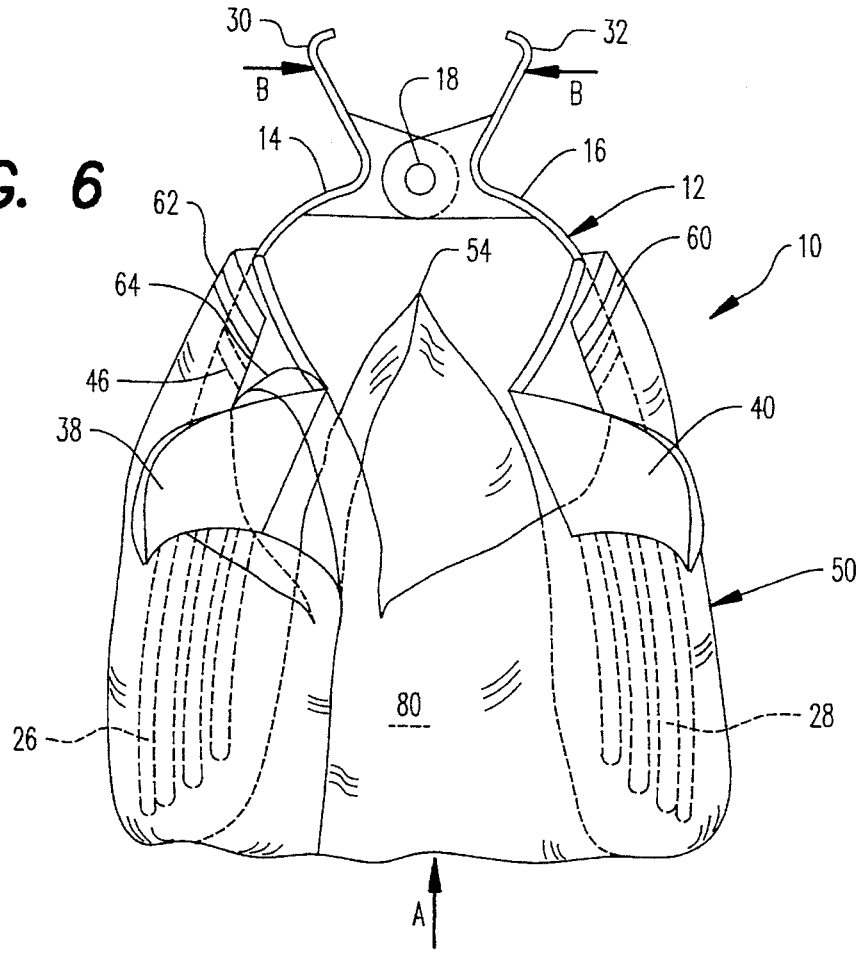
FIG. 6 is an end elevation view of FIG. 5.

Referring now to the drawings, the invention is shown generally at numeral 10 in FIGS. 5 and 6 and includes a pick up device shown generally at numeral 12 which comprises a pair of clamshell shaped members 14 and 16 hingedly connected about pin 18 by engagement through overlapping brackets 20 and 22 which extend inwardly from the inner concave surface of each clamshell shaped member 14 and 16, respectively. Each clamshell shaped member 14 and 16 is formed of generally uniformly thick molded plastic having an inner concave surface and an outer convex surface as shown.

Figure 1:
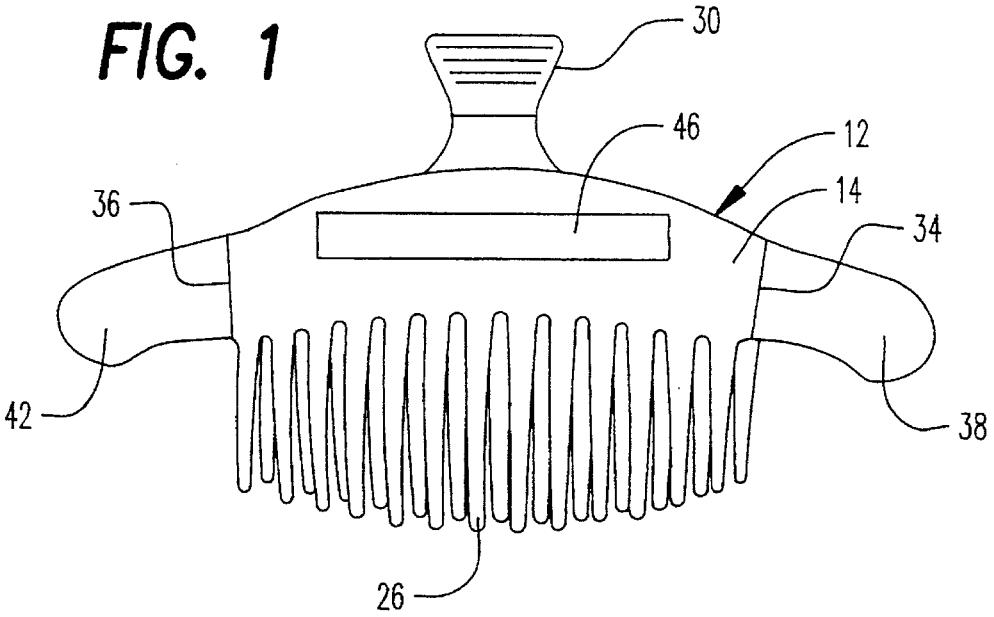
FIG. 1 is a side elevation view of the device.
Figure 2:
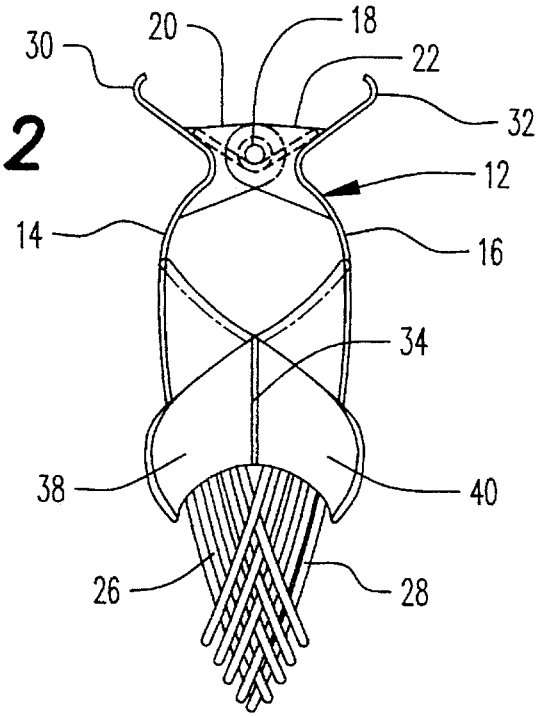
FIG. 2 is an end elevation view of FIG. 1.
Figure 3:
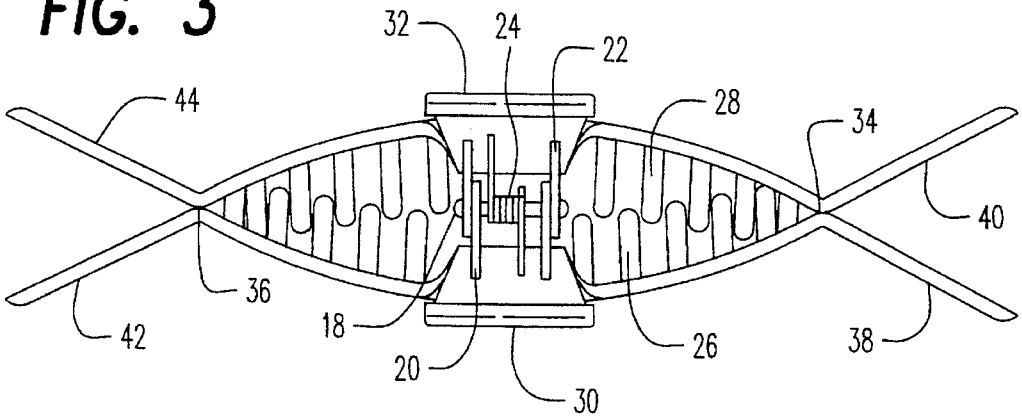
FIG. 3 is a top plan view of FIG. 1.

Spaced adjacent one side margin of each clamshell shaped member 14 and 16 are handles 30 and 32 which provide a gripping surface, as well as a squeezable means for opening and separating the clamshell shaped members as shown in FIGS. 5 and 6 from a normally closed position shown in FIGS. 1 to 3. This normally closed position wherein the clamshell shaped members 14 and 16 contact at 34 and 36 is maintained by spring 24 as best seen in FIG. 3.

A plurality of spaced fingers 26 and 28 are formed into and extend from the other side margin of each clamshell shaped member 14 and 16, respectively. These fingers 26 and 28 are parallel and spaced apart as shown and of generally arcuate configuration as a continuation of the otherwise solid surface of each clamshell shaped member 14 and 16. These fingers 26 and 28 having spaced, free distal ends, act through the flexible thin plastic material of the disposable bag 50, shown in FIG. 4 and in operational position in FIGS. 5 and 6, to more effectively dig into grass and soil for easier and more complete pick up of dog droppings and the like. These fingers 26 and 28 are also somewhat flexible for enhanced compliance to grass and ground.

Figure 4:
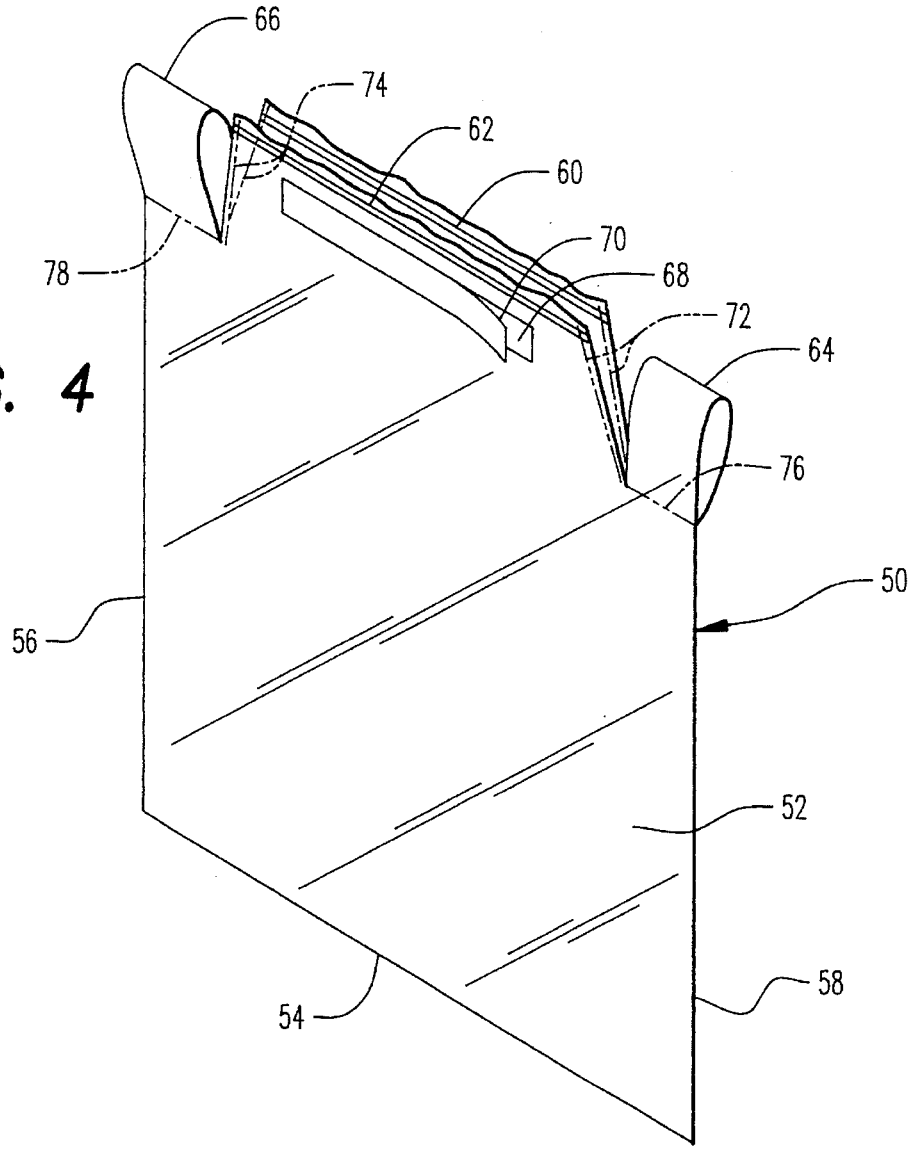
FIG. 4 is a perspective view of a disposable plastic bag utilized in conjunction with the invention in FIG. 1.

The disposable flexible bag 50 in FIG. 4 is formed of two thin flexible plastic sheets 52 connected along side margins 56 and 58 and bottom margin 54. The open end of the bag itself includes well known releasible engaging strips 60 and 62 for sealing the contents of the bag 50 after being filled as will be described herebelow. When the bag 50 is sealed along sealing lines 72, 74, 76 and 78, in combination with sealing strips 60 and 62, the entire bag contents are thus air tight as well to reduce odor.

Two loops 64 and 66 are formed into each corner of the bag 50 adjacent and outwardly positioned from the sealable bag opening. When the bag 50 is operationally positioned as shown in FIGS. 5 and 6, the bottom margin 54 is first inserted between the opened clamshell shaped members 14 and 16 into the position there shown, bottom margin 54 being thus furthest from the distal ends of fingers 26 and 28. By manually squeezing handles 30 and 32 in the direction of arrows B, the open position shown is maintained. The open end portion of the bag 50 is then turned inside out and positioned against the outer convex surface of the clamshell shaped members 14 and 16, thus protectively covering both sides and ends of the fingers 26 and 28.

Two methods of retaining the open ended portion of the bag 50 against the outer surfaces of the clamshell shaped members 14 and 16 are disclosed. Holding tabs 38, 40, 42 and 44 are mold formed integrally with the clamshell shaped members 14 and 16 and extend diagonally from each end margin of the solid surface of the clamshell shaped members 14 and 16 as shown. These holding tabs 38, 40, 42 and 44 are available, one at each end of the clamshell shaped members 14 and 16 for supportive engagement with the corresponding loops 64 and 66 of disposable bag 50. Additionally, a releasible adhesive strip may be added at 46 to the convex solid surface of each clamshell shaped member 14 and 16 as seen in FIG. 1 or, alternately, at 68, with removable protective covering strip 70 to each outer surface of the bag panels 50 adjacent the open sealable margins 60 and 62.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A device for picking up and removing dog droppings and the like comprising:

a pair of clamshell shaped members each of generally uniform, thin thickness and having an outer convex and an inner concave surface and hinge connected together along a central portion of adjacent spaced first side margins of said clamshell shaped members with said concave surfaces facing one another;

biasing means for maintaining said clamshell shaped members in an at-rest closed configuration with a second side margin of each said clamshell shaped member being pivoted about said hinge connection in close proximity to one another;

a pair of spaced squeezable handles each extending from said central portion of each said first side margin whereby, when said handles are held and squeezed together, said clamshell shaped members are pivotally moved about said hinge connection from the closed configuration to an open configuration wherein said second side margins are spaced apart;

closely spaced parallel arcuate finger means formed into each said clamshell member which extend from said second side margin to a central portion of each said clamshell shaped member, a distal end of a portion of said finger means of each said clamshell shaped member overlapping one another when in the closed configuration;

holding means extending away from each end margin of at least one said clamshell shaped member;

a flexible bag having an open end and closed side and bottom margins, a closed end portion of said bag in operational position being located between said clamshell shaped members with said bottom margin farthest from said finger means distal ends, an open end portion of said bag being turned inside out to cover said finger means and an exterior convex surface of each said clamshell shaped member, a retaining loop formed at each corner of said open end supportively engaging around one said holding means.

2. A device as set forth in claim 1, further comprising:

adhesive means for releasibly connecting said open end portion against said exterior convex surface.

3. A device as set forth in claim 2, further comprising: means for sealing said open end after use of said bag.

* * * * *